US007665533B2

(12) United States Patent
Hopwood et al.

(10) Patent No.: US 7,665,533 B2
(45) Date of Patent: Feb. 23, 2010

(54) ELECTRONIC THREADING CONTROL APPARATUS AND METHOD

(75) Inventors: Fergus Hopwood, Houston, TX (US); Richard Lewis, Tomball, TX (US); Phil Martin, Houston, TX (US)

(73) Assignee: Omron Oilfield & Marine, Inc., Houston, TX (US)

( * ) Notice: Subject to any disclaimer, the term of this patent is extended or adjusted under 35 U.S.C. 154(b) by 170 days.

(21) Appl. No.: 11/923,145

(22) Filed: Oct. 24, 2007

(65) Prior Publication Data

US 2008/0093088 A1 Apr. 24, 2008

Related U.S. Application Data

(60) Provisional application No. 60/862,693, filed on Oct. 24, 2006.

(51) Int. Cl.
*E21B 19/16* (2006.01)

(52) U.S. Cl. ..... 166/380; 166/77.51; 166/250.01; 173/164

(58) Field of Classification Search ..... 166/381, 166/379, 77.51, 380, 250.01; 173/164
See application file for complete search history.

(56) References Cited

U.S. PATENT DOCUMENTS

2005/0077084 A1 * 4/2005 Kracik et al. ..... 175/24

* cited by examiner

*Primary Examiner*—Giovanna C Wright
(74) *Attorney, Agent, or Firm*—Osha • Liang LLP

(57) ABSTRACT

A system to control a threading operation includes a first tubular and a second tubular, wherein the first tubular and the second tubular include corresponding thread profiles. The system further includes a drive assembly configured to rotate the second tubular with respect to the first tubular, wherein vertical and rotation movements of the drive assembly are controllable through a drive assembly controller, and wherein the drive assembly controller is configured to operate in a threading mode when the second tubular is threaded with the first tubular.

25 Claims, 4 Drawing Sheets

ELECTRONIC THREADING CONTROL APPARATUS AND METHOD

CROSS-REFERENCE TO RELATED APPLICATIONS

This Application claims the benefit of the following provisional application under 35 U.S.C. §119(e): U.S. Provisional Patent Application Ser. No. 60/862,693 filed on Oct. 24, 2006 and incorporated by reference in its entirety herein.

BACKGROUND

1. Field of the Disclosure

Embodiments disclosed herein relate generally to tubular connections. More specifically, embodiments of the present disclosure relate to a method and apparatus for controlling the rate of assembly of tubulars to maintain a rate within a selected set of parameters during make-up.

2. Background Art

Drilling wells in subsurface formations for oil and gas wells is expensive and time consuming. Formations containing oil and gas are typically located thousands of feet below the earth's surface. Therefore, thousands of feet of rock and other geological formations must be drilled through in order to establish production. Casing joints, liners, and other oilfield tubulars are frequently used to drill, complete, and produce wells. For example, casing joints may be placed in a wellbore to stabilize and protect a formation against high wellbore pressures (e.g., wellbore pressures that exceed a formation pressure) that could otherwise damage the formation. Casing joints are sections of pipe (e.g., steel or titanium), which may be coupled in an end-to-end manner by threaded connections, welded connections, or any other connection mechanisms known in the art.

It should be understood that certain terms are used herein as they would be conventionally understood, particularly where threaded tubular joints are connected in a vertical position along their central axes such as when making up a pipe string for lowering into a well bore. Typically, in a male-female threaded tubular connection, the male component of the connection is referred to as a "pin" member and the female component is called a "box" member. As used herein, "make-up" refers to engaging a pin member into a box member and threading the members together through torque and rotation.

Referring initially to FIG. 1, a rotary drilling system 10 including a land-based drilling rig 11 is shown. While drilling rig 11 is depicted in FIG. 1 as a land-based rig, it should be understood by one of ordinary skill in the art that embodiments of the present disclosure may apply to any drilling system including, but not limited to, offshore drilling rigs such as jack-up rigs, semi-submersible rigs, drill ships, and the like. Additionally, although drilling rig 11 is shown as a conventional rotary rig, wherein drillstring rotation is performed by a rotary table, it should be understood that embodiments of the present disclosure are applicable to other drilling technologies including, but not limited to, top drives, power swivels, downhole motors, coiled tubing units, and the like.

As shown, drilling rig 11 includes a mast 13 supported on a rig floor 15 and lifting gear comprising a crown block 17 and a traveling block 19. Crown block 17 may be mounted on mast 13 and coupled to traveling block 19 by a cable 21 driven by a draw works 23. Draw works 23 controls the upward and downward movement of traveling block 19 with respect to crown block 17, wherein traveling block 19 includes a hook 25 and a swivel 27 suspended therefrom. Swivel 27 may support a Kelly 29 which, in turn, supports drillstring 31 suspended in wellbore 33. Typically, drillstring 31 is constructed from a plurality of threadably interconnected sections of drill pipe 35 and includes a bottom hole assembly ("BHA") 37 at its distal end.

As is well known to those skilled in the art, the weight of drillstring 31 may be greater than the optimum or desired weight on bit 41 for drilling. As such, part of the weight of drillstring 31 may be supported during drilling operations by lifting components of drilling rig 11. Therefore, drillstring 31 may be maintained in tension over most of its length above BHA 37. Furthermore, because drillstring 31 may exhibit buoyancy in drilling mud, the total weight on bit may be equal to the weight of drillstring 31 in the drilling mud minus the amount of weight suspended by hook 25 in addition to any weight offset that may exist from contact between drillstring 31 and wellbore 33. The portion of the weight of drillstring 31 supported by hook 25 is typically referred to as the "hook load" and may be measured by a transducer integrated into hook 25.

Generally, threaded tubular products (typically casing, but may apply to drill-pipe, drill-collars, etc, referred to as tubulars or joints) may be assembled, or made-up, on drilling rigs by holding a lower joint fixed in the rotary table and by turning and lowering an upper joint into the lower joint. The upper joint may be turned by using the topdrive and lowering may be accomplished using the drawworks. Alternatively, already made-up tubulars may be unthreaded, also known as break-out, to disassemble a tubular string.

While "spinning" the two joints together (while the threads are engaging), torque may be limited to a fraction of a desired connection torque until the threads have fully engaged. Once the threads have fully engaged, the rotating torque may rise to the spinning torque limit and the rotation may stall. To complete the connection process, the torque limit is then increased to a final desired connection value, at which point rotation may re-commence and stall again at the final desired torque value, or make-up torque, for the connection.

Once the threads on the upper and lower joints are engaged, a drilling operator must lower the tubular at a correct rate to successfully spin the joints together. If the joint is lowered too quickly or too slowly, the threading process may stall out prematurely, or damage the threads. To lower at the "correct" rate while the threads are spinning together, the drilling operator may watch the indicated hookload and may modulate the drawworks speed by hand. If the lowering speed is too great, then the hookload decreases and the drilling operator may slow down, and vice-versa. In addition, the drilling operator is responsible for watching the rig floor and the tubular joint to ensure the process is safely and properly conducted.

While lowering the first tubular to be stabbed into the second tubular, very accurate control of the lowering speed may be required. Typically, the drilling operator may use a joystick that is scaled to allow a maximum operating speed of the drawworks to be achieved at a full travel of the joystick. The drilling operator may enter a reduced maximum speed, which would achieve the fine control, but may then need to manually enter a faster speed in order to manipulate the assembled tubulars after threading is completed.

Accordingly, there exists a need for an improved control system which reduces drilling operator intervention during threading and unthreading of tubular connections.

SUMMARY OF THE DISCLOSURE

In one aspect, embodiments disclosed herein relate to a system to control a threading operation, the system including a first tubular and a second tubular, wherein the first tubular and the second tubular include corresponding thread profiles, a drive assembly configured to rotate the second tubular with respect to the first tubular, wherein vertical and rotation movements of the drive assembly are controllable through a drive assembly controller, and wherein the drive assembly controller is configured to operate in a threading mode when the second tubular is threaded with the first tubular.

In another aspect, embodiments disclosed herein relate to a method to control a threading operation, the method including manipulating vertical and rotational displacements of a drive assembly with a drive assembly controller, driving a first tubular with respect to a second tubular with the drive assembly, and adjusting a scale of the drive assembly controller during a threading operation between the first tubular and the second tubular.

In another aspect, embodiments disclosed herein relate to a method to control a threading operation, the method including manipulating vertical and rotational displacements of a drive assembly with a drive assembly controller and driving a first tubular with respect to a second tubular with the drive assembly. The method further includes restricting the displacement of the drive assembly to a vertical to rotational ratio during a threading operation and setting the vertical to rotational ratio based upon a thread pitch of one of the first tubular member and the second tubular member.

Other aspects and advantages of the invention will be apparent from the following description and the appended claims.

DETAILED DESCRIPTION

In one aspect, embodiments disclosed herein relate to tubular connections. More specifically, embodiments of the present disclosure relate to a method and apparatus for controlling the rate of assembly of tubulars within a selected set of parameters during make-up and/or break-out.

Figure 2:
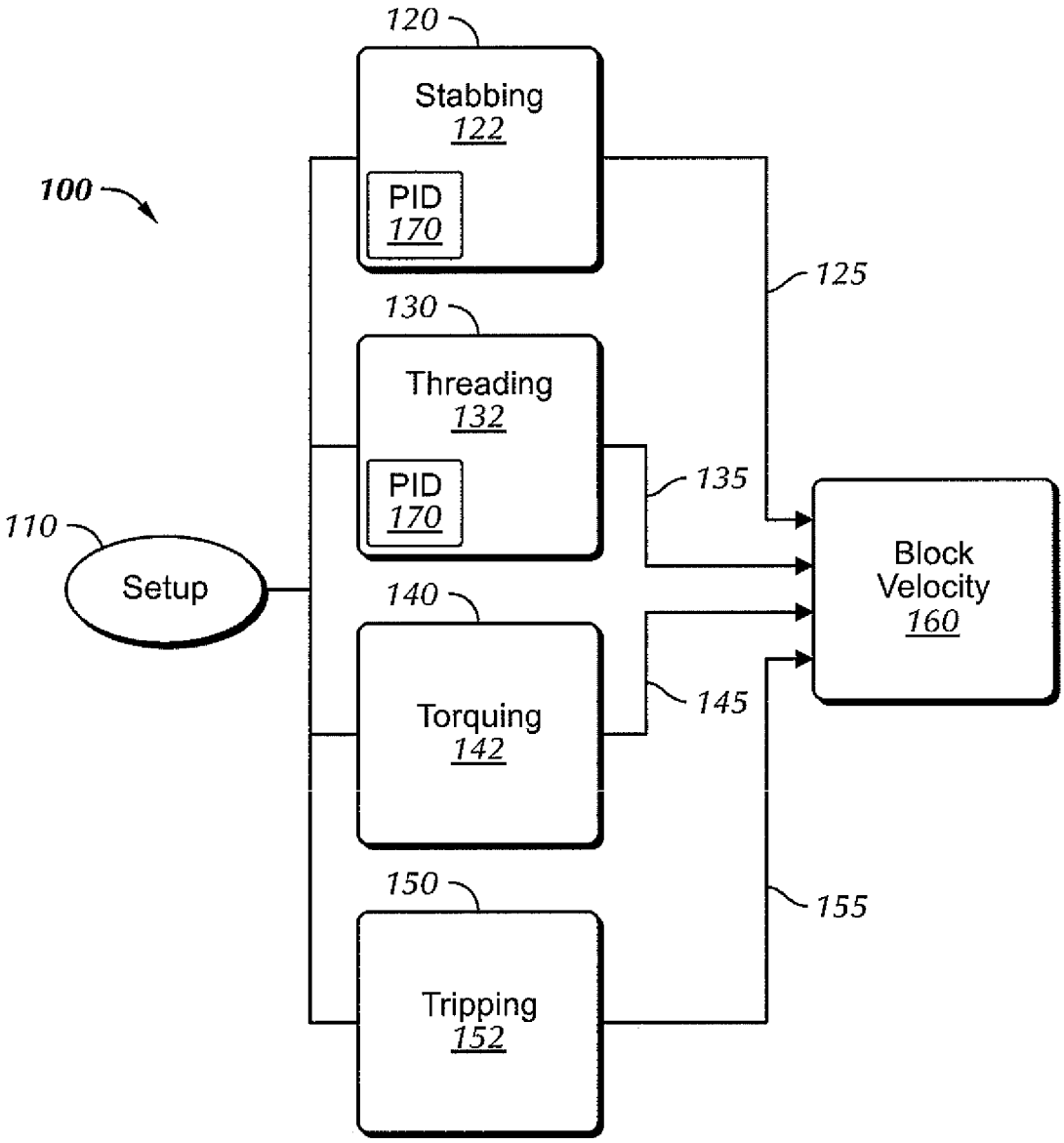
FIG. 2 is a schematic block diagram of an electronic threading control system in accordance with embodiments of the present disclosure.

Referring to FIG. 2, an electronic threading control system 100 having multiple operating modes in accordance with embodiments of the present disclosure is shown. During operation, the drilling operator may have multiple controls at his disposal for use during make-up or break-out of a threaded connection. In embodiments disclosed herein, make-up of a threaded connection may be used interchangeably with threading of the connection and break-out of a threaded connection may be used interchangeably with unthreading of the connection. Initially, user-defined values or setpoints may be entered 110 through a human machine interface (HMI) to setup or configure the system before beginning operations. The HMI may include a computer, handheld device, or other equipment as will be known to a person skilled in the art. User-defined values will be discussed in further detail later.

Once the user-defined values are input into the HMI, control system 100 may transition through multiple operating modes to perform various functions involved in making up or breaking out a tubular connection. The operating modes of control system 100 may include a stabbing mode 120, a threading mode 130, a torquing mode 140, and a tripping mode 150. The multiple operating modes determine a block velocity 160 whether it be a vertical movement such as in stabbing mode 120 and tripping mode 150, vertical and rotational movement as in threading mode 130, or a rotational movement as in torquing mode 140.

The multiple operating modes of control system 100 may further include an integrated Forward/Reverse direction mode which may be used to control the direction in which operations proceed; namely whether a connection is being threaded or unthreaded. The Forward/Reverse direction allows the drilling operator to move the tubulars in a vertical direction as needed in making up or breaking a connection. The Forward/Reverse direction mode may have a selection pushbutton on the HMI for operation. Still further, a calibration mode may be used to automatically determine and compensate for the inherent friction in the sheaves, or pulleys mounted on the top of the rig.

To calibrate, the blocks may move slowly up and down a preset distance while measuring the hookload to determine a correction factor for friction while moving. Various operating modes of control system 100 may have interfaces such as pushbuttons, switches, levers, or other devices known to a person skilled in the art. Further, data or feedback from control system 100 may be viewed with a computer screen, heads-up display, or other devices known to those skilled in the art. The multiple operating modes of control system 100 are described in more detail below.

Stabbing mode 120 of control system 100 may be used to raiser or lower the tubulars before make-up or after break-out of the tubular connection. Stabbing mode 120 may be used when the threads of the tubulars are not in contact and up to the moment when a specified axial force is present on the threads. In selected embodiments, stabbing mode 120 may comprise both vertical and rotational movement of the tubulars. A joystick or any other type of device for controlling, manipulating, or guiding the drawworks may be used as would be known to a person skilled in the art. The joystick may operate on a "coarse" scale while in stabbing mode 120, the coarse scale comprising a speed range suitable for moving the tubulars over large distances. As an end of the first tubular approaches an end of the second tubular, the threads may contact, resulting in an axial force on the ends of the connection. The control system may run in the stabbing mode until an axial force on the connection is at a specified axial force setpoint, at which point the control system may stop the drawworks movement so as not to create any further axial force between the threads of the first tubular and second tubular. As shown, when control system 100 is in stabbing mode 120, a block velocity 160 may be determined by stabbing mode output 125.

Threading mode 130 of control system 100 may be used after the threads of the tubulars are in contact and during threading or unthreading of the connection. Threading mode 130 comprises both vertical and rotational movement of the tubulars as the drawworks is hoisting/lowering and rotating the tubulars at given velocities depending on whether threading or unthreading is occurring. In threading mode 130, control system 100 may automatically switch from the "coarse" scale used in stabbing mode 120 to a "fine" scale. The fine scale comprises a smaller speed range suitable for accurately engaging the starting threads of the tubulars. Further, threading mode 130 may include a or more particularly, the hoisting/lowering of the drawworks may be based on the thread pitch and spin speed of the tubular. Threading mode 130 may operate up to a specified torque, at which point no further torque may be applied to the connection while in threading mode 130. Further, when control system 100 is in threading mode 130, block velocity 160 may be determined by threading mode output 135.

Further, in selected embodiments, while in stabbing mode 120 or threading mode 130, a force limiting feature may be activated which may increase/decrease the hoisting/lowering speed based on hookload changes caused by the threads being axially loaded. The force limiting feature may be controlled through a PID controller which will be described in more detail later, or any other means known to a person skilled in the art.

Torquing mode 140 of control system 100 may be used after rotation of the first tubular with respect to the second tubular has stalled, at which point torquing mode 140 may apply additional torque up to a specified make-up torque of the connection. The specified make-up torque may vary based on thread pitch, size of the tubulars, thread material, intended use, or any other variables known to a person skilled in the art. Torquing mode 140 may comprise rotational movement of the first tubular; however, slight vertical movement may occur as well. When control system 100 is in torquing mode 140, block velocity 160 may be determined by torquing mode output 145.

Tripping mode 150 of control system 100 may be used either after connection make-up or break-out to allow full tripping of an individual tubular or a string of tubulars. As is known in the art, tripping may be defined as the act of pulling a tubular out of a hole or replacing it in the hole. Tripping mode 150 may be used to hoist a completed tubular assembly to a suitable position for setting slips on the tubular connection. The slips are a device well known in the art used to grip the tubulars in a relatively non-damaging manner and suspend it in a rotary table. A person of ordinary skill in the art will understand methods to attach the slips to the tubular connection as well as operate the slips. Tripping mode 150 may also be used to remove individual tubular pieces after breaking the connection and placing them in a tubular rack or holding device. When control system 100 is in tripping mode 150, block velocity 160 may be determined by tripping mode output 155.

Figure 1:
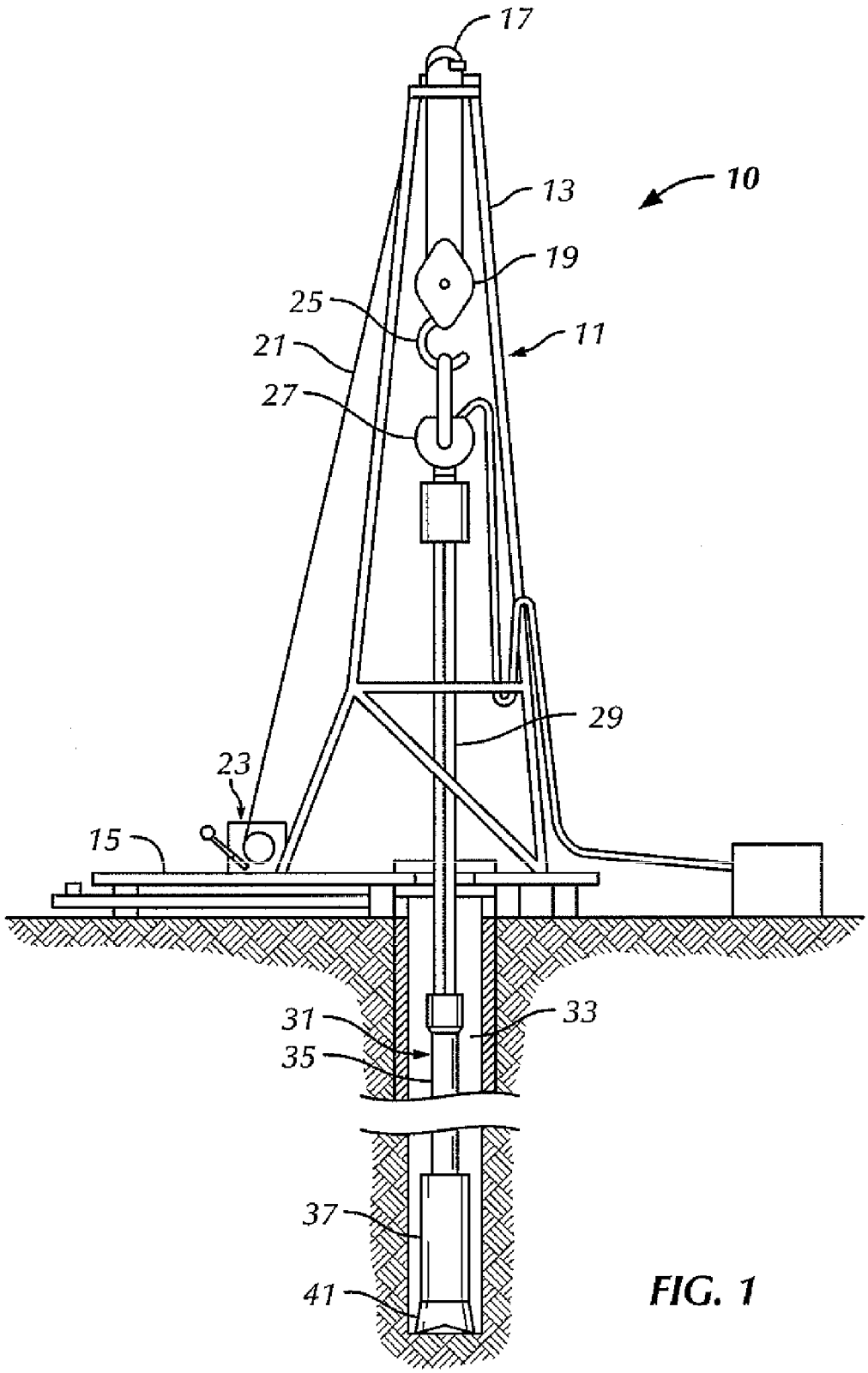
FIG. 1 is a schematic view drawing of a drilling rig to drill a wellbore.

Referring back to FIG. 1, the weight of drillstring 31 may be greater than the optimum or desired weight on bit 41 for drilling. As such, part of the weight of drillstring 31 may be supported during drilling operations by lifting components of drilling rig 11. Therefore, drillstring 31 may be maintained in tension over most of its length above BHA 37. Furthermore, because drillstring 31 may exhibit buoyancy in drilling mud, the total weight on bit may be equal to the weight of drillstring 31 in the drilling mud minus the amount of weight suspended by hook 25 in addition to any weight offset that may exist from contact between drillstring 31 and wellbore 33.

The portion of the weight of drillstring 31 supported by hook 25 is typically referred to as the "hook load" and may be measured by a transducer integrated into hook 25. In certain aspects of embodiments of the present disclosure, the control system may prevent excessive axial force or hookload from being applied to the threads while engaging and threading a connection. From the thread pitch and actual spin speed entered by the drilling operator, the control system may calculate the speed at which the tubular needs to be lowered during the threading process. In addition, a PID loop may be applied to the change in hookload, to compensate for inaccuracies in the actual lowering speed and/or thread pitch entry.

Figure 3:
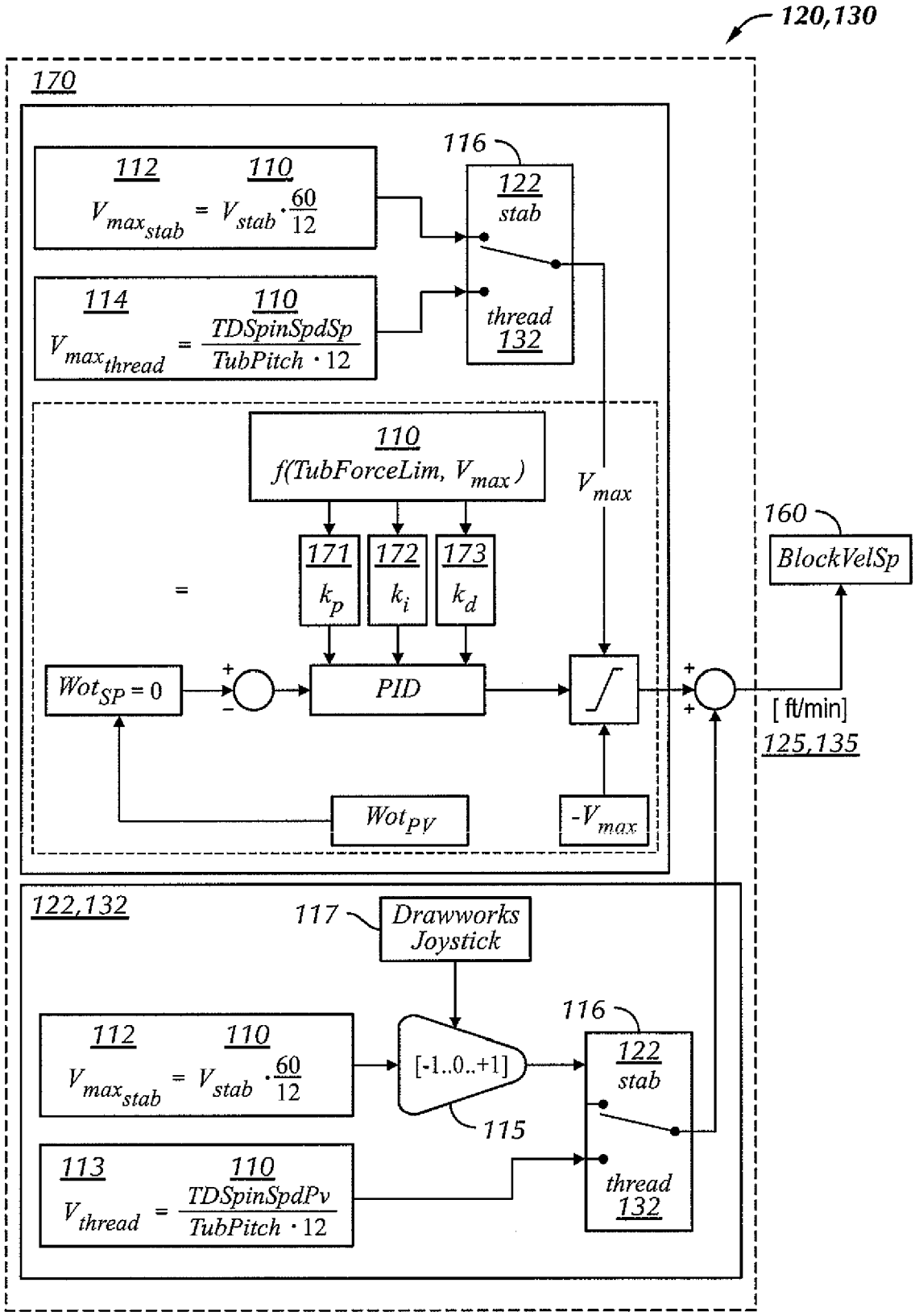
FIG. 3 is a schematic block diagram of an alternative electronic threading control system in accordance with embodiments of the present disclosure.

Referring now to FIG. 3, a more detailed schematic of stabbing mode 120 and threading mode 130 in accordance with embodiments of the present disclosure is shown. In FIG. 3, the internal processes involving a stabbing controller 122 and a threading controller 132 in conjunction with a PID controller 170 are shown. Generally, a proportional feedback control (P) may reduce error responses to disturbances by may still allow a nonzero steady-state error to constant inputs. When a controller includes a term proportional to the integral of the error (I), then the steady-state error may be eliminated, and further adding a term proportional to the derivative of the error (D) may improve the dynamic response. Combing the three yields a classical PID controller 170 which, for example, is widely used in process and robotics industry. One of ordinary skill in the art will appreciate that PID controller 170 may also be used in conjunction with any algorithm associated with either PID or PI controllers. As such, additional inputs or constants to the controller may be required.

Initially, user-defined values may be entered on the HMI for the following inputs as described below:

A. Tubular thread pitch [TPI] (TubPitch). Using a thread pitch of the upper and second tubulars and a tubular spin speed, the control system may calculate a lowering speed required to thread the connection together.

B. Stabbing Speed [in/sec] ($v_{stab}$). Control system 100 may use this as a maximum lowering/hoisting speed when in a stabbing mode.

C. Stabbing Connection Force [lb] (TubForceLim). While the drilling operator lowers the first tubular into the second tubular, control system 100 may limit the axial force applied to the connection threads to this value.

D. Spin torque setpoint [k·ft-lb]. This is a maximum torque that will be applied to the first tubular while threading the connection together in threading mode 130.

E. Final connection torque setpoint [k·ft-lb]. This is the specified final make-up torque applied to the first tubular once the connection has been thread together when in torquing mode 140.

F. Spin speed setpoint [rpm] (TdSpinSpdSp). This is a speed at which the first tubular is turned while threading the connection together.

Referring still to FIG. 3, in certain embodiments, when control system 100 is in stabbing mode 120 or threading mode 130, PID controller 170 may be used with stabbing controller 122 and threading controller 132 to compensate for inaccuracies in the lowering speed of the tubulars. PID controller 170 may work in conjunction with stabbing controller 122 and threading controller 132 to yield stabbing output 125 and threading output 135, which determines block velocity 160. Within the stabbing controller 122 and threading controller 132, user-defined values 110, including stabbing speed ($v_{stab}$), a present value of the topdrive spin speed (TdSpinSpdPv), and tubular thread pitch [TPI] (TubPitch) may be entered to initially configure stabbing controller 122 or threading controller 132. Calculated from the user-defined values are $v_{maxstab}$ 112, defined as the maximum block speed while stabbing two tubulars, and $v_{thread}$ 113, defined as the theoretical block speed appropriate for threading tubular joints of a given TPI with a relative turning speed of TdSpinSpdPv.

As shown, a selector component 116 may be used to switch between stabbing controller 122 and threading controller 132. Further, a scaling component 115 may be used in conjunction with stabbing controller 122. Scaling component 115 may allow the drilling operator to choose between a "coarse" scale used in stabbing mode 120, and a "fine" scale used in threading mode 130. As previously mentioned, the coarse scale moves the blocks over a larger range and at a faster speed than the fine scale.

Still to FIG. 3, PID controller 170 may work with stabbing controller 122 and threading controller 132 to reduce inaccuracies while in stabbing mode 120 and threading mode 130. User-defined values $v_{stab}$, TdSpinSpdSp, and TubPitch 110 may be input and used to calculate $v_{maxstab}$ 112 and $v_{maxthread}$ 114, which is the maximum block speed allowed while threading two tubulars. Further, a calculated axial force on the threads, Wot, may be derived by taking the difference between a value of hookload prior to threads being engaged, $Hookload_{zero}$, and a present value of hookload, $Hookload_{Pv}$. Still further, a proportional gain 171, $k_p$, an integral gain 172, $k_i$, and a derivative gain 173, $k_d$, may be used to maintain a value of $v_{max}$, or the maximum speed allowed during either stabbing mode 120 or threading mode 130, between defined upper and lower limits. Selector component 116 switches between stabbing controller 122 and threading controller 132 as previously described. Stabbing mode output 125 or threading mode output 135 may determine block velocity 160.

Figure 4A:
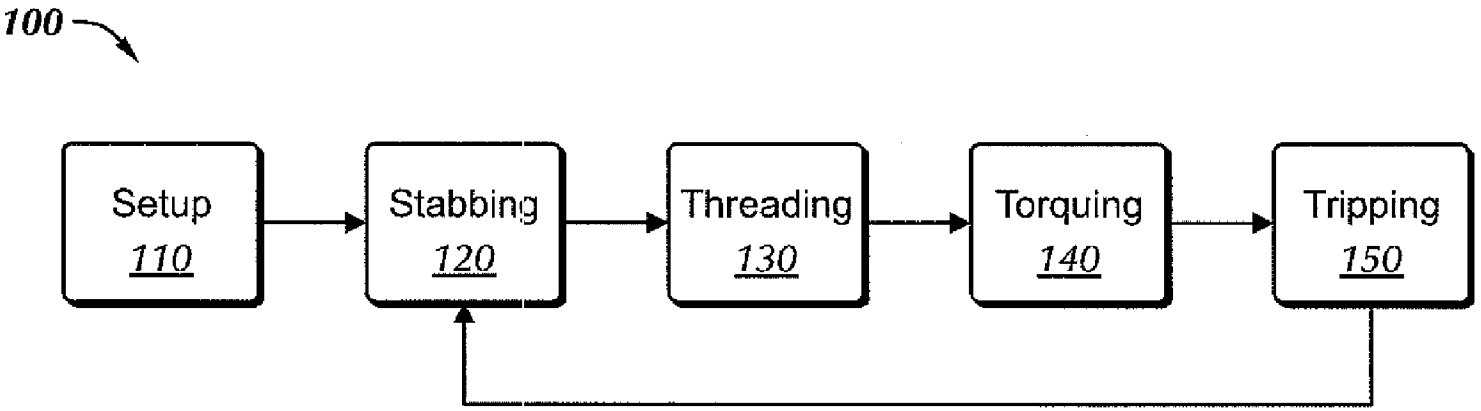
FIG. 4A is a methodology block diagram of threading a tubular in accordance with embodiments of the present disclosure.

Referring now to FIG. 4A, a general methodology by which control system 100 may be used to make-up a threaded connection is described in accordance with embodiments of the present disclosure. In this embodiment, Forward/Reverse selection as described above may be set in the "forward" configuration, as this will be associated with tightening or threading the connection. Initially, values may be input 110 through the HMI to set-up the system for threading the connection together. A first tubular may be positioned above a second tubular and lowered with the drawworks, so as to have an end of the first tubular close to an end of the second tubular.

In selected embodiments, the drawworks may hoist the first tubular to a distance of about three feet from the second tubular. At this point, the calibration mode described above may take measurement of up and down sheave friction values to determine the correction factor for friction while moving. Further, the first tubular may be lowered to within a close proximity of the second tubular. Next, control system 100 may transition to stabbing mode 120, during which the drawworks may be lowered at a desired speed and stop once the axial force on the connection is at a selected stabbing weight setpoint, defined above as the stabbing connection force. The system may now transition to threading mode 130, at which point the topdrive may turn and the drawworks may lower at the correct rate to thread the connection together. Once the connection has finished turning and stalled out, the system may switch to torquing mode 140 and apply a final connection torque to the tubulars. When the connection has been fully made-up, the system may enter a tripping mode 150, when the drawworks picks up the completed tubular assembly and re-positions the tubular assembly to make-up the next connection.

Figure 4B:
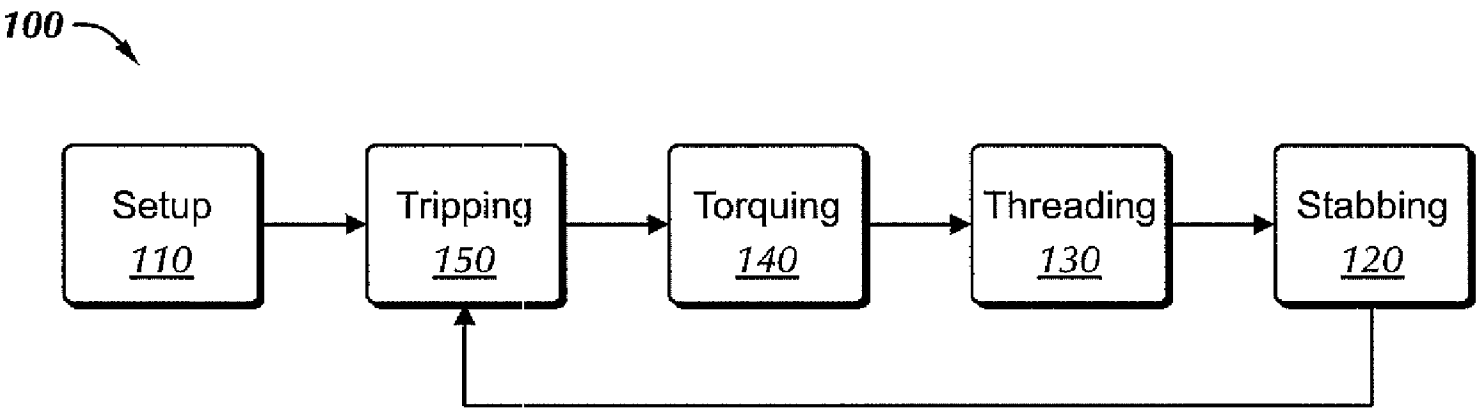
FIG. 4B is a methodology block diagram of unthreading a tubular in accordance with embodiments of the present disclosure.

Further, as shown in FIG. 4B, a general methodology by which control system 100 may be used for breaking out a connection is described in accordance with embodiments of the present disclosure. In this embodiment, Forward/Reverse selection as described above may be set in "reverse" configuration which is associated with unthreading the connection. Similar to making a connection, setup values 110 may be initially determined and used to configure the system. Next, the system may enter the tripping mode 150, with the tubular assembly being hoisted until the lower connection is at a suitable height to set the slips. Once the slips are set, the system may transition to torquing mode 140 to break the connection between the upper and second tubulars. When the connection begins to turn, the system may transition to threading mode 130, which begins hoisting with the drawworks to unthread and loosen the connection. Once the first tubular has disengaged from the second tubular, the system may enter stabbing mode 120 at which point the first tubular is hoisted clear of the second tubular. The system may return to tripping mode 150 to place the individual tubular in a rack for slips.

Advantageously, embodiments of the present disclosure for may provide a control system which may prevent excess axial force from being applied to the threads of the tubulars while engaging and threading or disengaging and unthreading a connection. The user-defined inputs and automation of the control system may reduce human intervention in the operation and therefore reduce error. Advantageously, electronic threading control systems in accordance with embodiments of the present disclosure may allow for several variables to simultaneously affect the drilling process without the need to switch between them. Former systems required a user (or a computer) to constantly monitor several variables and switch between them when one variable reached a critical level. Thus, much attention had to be directed to various gauges, inputs, and alarms to ensure the drilling assembly did not get too over or under loaded during operations.

Further, the addition of the PID controller may reduce inaccuracies or error by providing constant adjustments to keep the axial force from exceeding a given limit. Embodiments of the present disclosure may provide automated operations and controls which increase the speed at which tubular make-up or break-out operations may occur. By reducing the number of individual decisions a drilling operator must make and control on each individual tubular, embodiments of the present disclosure may improve productivity by increasing efficiency of engaging/disengaging tubulars and speeding up the process. The increased efficiency may have a direct effect on decreasing rig time needed for making up or breaking the tubular connections and ultimately reducing costs associated with rig time.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A system to control a threading operation, the system comprising:

a drive assembly configured to rotate a second tubular with respect to a first tubular, wherein vertical and rotation movements of the drive assembly are controllable through a drive assembly controller;

wherein the drive assembly controller is configured to operate in a threading mode when the second tubular is threaded with the first tubular;

wherein the drive assembly controller operates in a threading scale when in the threading mode;

wherein the threading scale is selected based upon a thread pitch of at least one of the first and the second tubulars.

2. The system of claim 1, wherein the drive assembly operates in a torque mode when not in the threading mode.

3. The system of claim 2, wherein the torque mode is selected to achieve the maximum operating speed of the drive assembly.

4. The system of claim 1, wherein the threading mode comprises a ratio of vertical to rotation movements restricting the drive assembly.

5. The system of claim 1, wherein the drive assembly controller comprises a joystick.

6. The system of claim 1, wherein the drive assembly controller comprises a heads-up display.

7. The system of claim 1, further comprising programmable logic circuitry to control the displacement and rotation of the second tubular through the drive assembly.

8. The system of claim 1, wherein the drive assembly comprises a top drive.

9. The system of claim 1, wherein the drive assembly comprises a rotary table.

10. The system of claim 1, further comprising a securing device configured to hold the first tubular to allow the second tubular to rotate with respect thereto.

11. A system to control a threading operation, the system comprising:

a drive assembly configured to rotate a second tubular with respect to a first tubular, wherein vertical and rotation movements of the drive assembly are controllable through a drive assembly controller;

wherein the drive assembly controller is configured to operate in a threading mode when the second tubular is threaded with the first tubular;

wherein the threading mode comprises a ratio of vertical to rotation movements restricting the drive assembly;

wherein the ratio is selected based upon a thread pitch of at least one of the first and the second tubulars.

12. A system to control a threading operation, the system comprising:

a drive assembly configured to rotate a second tubular with respect to a first tubular, wherein vertical and rotation movements of the drive assembly are controllable through a drive assembly controller;

wherein the drive assembly controller is configured to operate in a threading mode when the second tubular is threaded with the first tubular;

a transducer configured to measure axial loads experienced by thread profiles of the first and second tubulars.

13. A method to control a threading operation, the method comprising:

manipulating vertical and rotational displacements of a drive assembly with a drive assembly controller;

driving a first tubular with respect to a second tubular with the drive assembly; and adjusting a scale of the drive assembly controller during a threading operation between the first tubular and the second tubular;

wherein the adjustment of the scale allows more precise control of the vertical and rotational displacements of the drive assembly during the threading operation.

14. The method of claim 13, wherein the threading operation comprises threadably coupling the first tubular with the second tubular.

15. The method of claim 13, wherein the threading operation comprises threadably de-coupling the first tubular from the second tubular.

16. The method of claim 13, wherein the drive assembly comprises a top drive.

17. The method of claim 13, further comprising securing the first tubular relative to the second tubular.

18. The method of claim 13, wherein the driving of the first tubular with respect to the second tubular comprises rotationally driving the first tubular with respect to the second tubular.

19. The method of claim 13, wherein the driving comprises vertical driving.

20. The method of claim 13, wherein the driving comprises vertical and rotational driving.

21. A method to control a threading operation, the method comprising:

manipulating vertical and rotational displacements of a drive assembly with a drive assembly controller;

driving a first tubular with respect to a second tubular with the drive assembly; and restricting the displacement of the drive assembly to a vertical to rotational ratio during a threading operation; and setting the vertical to rotational ratio based upon a thread pitch of one of the first tubular member and the second tubular member.

22. The method of claim 21, wherein the threading operation comprises threadably coupling the first tubular with the second tubular.

23. The method of claim 21, wherein the threading operation comprises threadably de-coupling the first tubular from the second tubular.

24. The method of claim 21, wherein the adjustment of the scale allows more precise control of the vertical and rotational displacements of the drive assembly during the treading operation.

25. The method of claim 21, wherein the drive assembly comprises a top drive.

* * * * *